United States Patent [19]

Barwise

[11] 4,315,652

[45] Feb. 16, 1982

[54] ANGLE CONTROL MECHANISM FOR GRAPPLE

[75] Inventor: Robert D. Barwise, Bovey, Minn.

[73] Assignee: Robil Company, Minneapolis, Minn.

[21] Appl. No.: 145,421

[22] Filed: May 1, 1980

[51] Int. Cl.[3] ..... B66C 1/10

[52] U.S. Cl. ..... 294/86 R; 294/112; 414/739; 414/569

[58] Field of Search ..... 294/86 R, 112, 67 BC; 414/739, 735, 732, 569; 254/320, 340; 212/8 R

[56] References Cited

U.S. PATENT DOCUMENTS

| | | | |
|---|---|---|---|
| 3,746,193 | 7/1973 | Eaves | 414/569 |
| 3,841,507 | 10/1974 | Barwise | 294/112 |
| 4,217,076 | 8/1980 | Robnett et al. | 414/739 |

*Primary Examiner*—James B. Marbert

*Attorney, Agent, or Firm*—Kinney, Lange, Braddock, Westman and Fairbairn

[57] ABSTRACT

A grapple skidder vehicle has a grapple assembly rotatably and pivotally mounted with respect to an outer boom point end portion of a boom extending from the vehicle. The grapple assembly is supported from a cylindrical rotator shaft which is mounted for rotation in a bushed bearing which extends integrally upwardly from a base plate which forms a part of the boom point portion of the boom. The vertical thrust of the weight and load on the grapple assembly is transmitted through the rotator shaft to a rotator shaft operator arm concentric with and encircling the bushed bearing and to a relatively soft wear plate situated between the base plate and a bottom disc-shape base portion of the rotator shaft operator arm. The grapple assembly is pivoted with respect to the boom by a linear hydraulic motor pivotally connected between an outer end portion of the rotator shaft operator arm and the boom. Valve controls for the linear hydraulic motor can selectively: (1) cause the grapple assembly to rotate in a clockwise direction; (2) cause the grapple assembly to rotate in a counterclockwise direction, or (3) allow the grapple assembly to be free of any hydraulic motor control while unloading the source of hydraulic fluid under pressure back to a hydraulic reservoir supplying the source.

4 Claims, 9 Drawing Figures

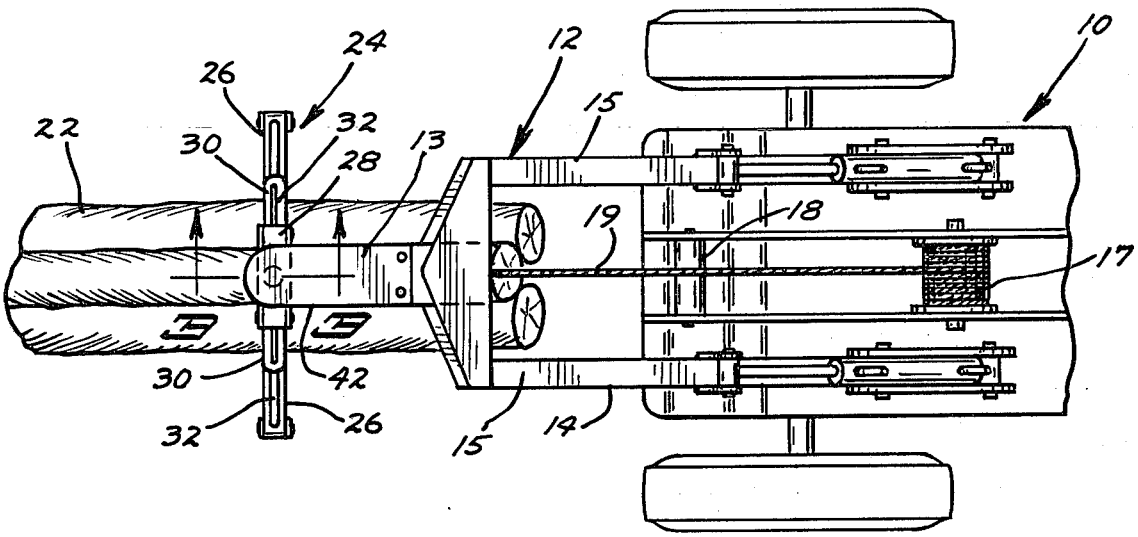
FIG. 2
FIG. 1
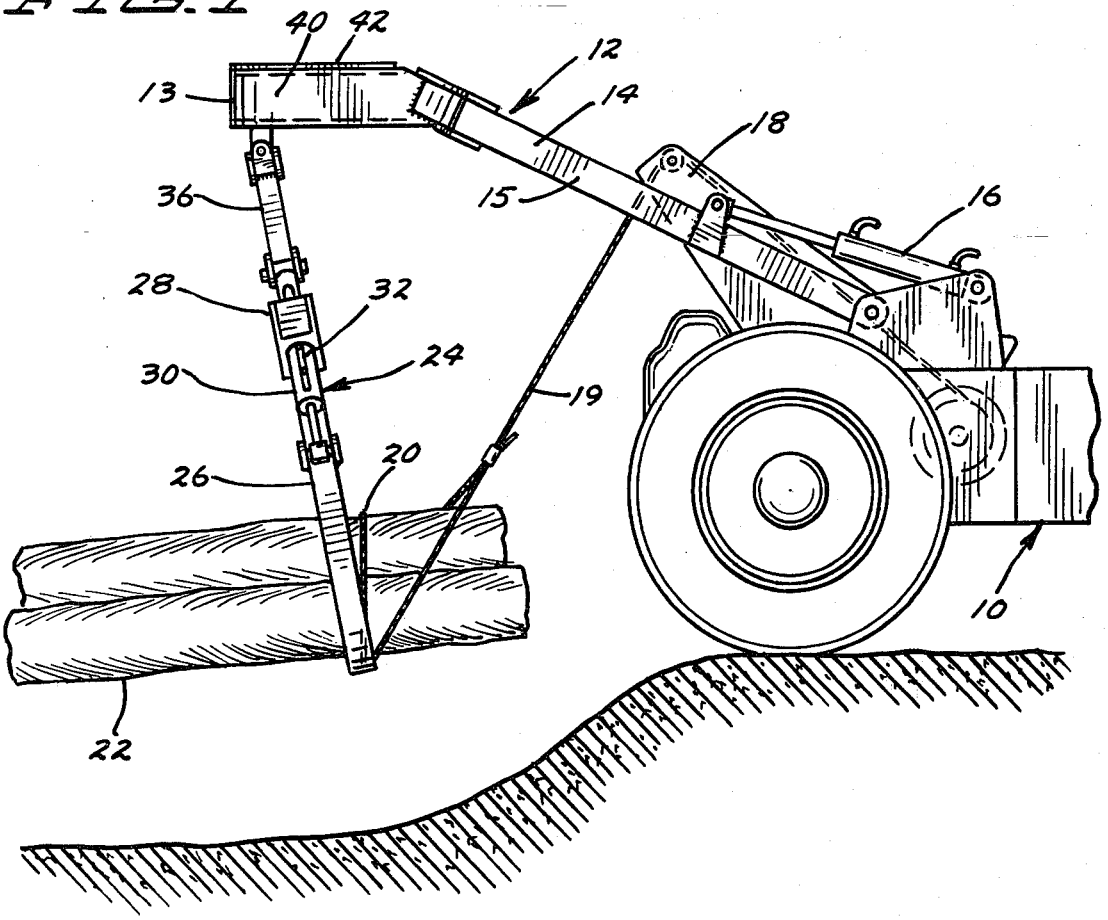

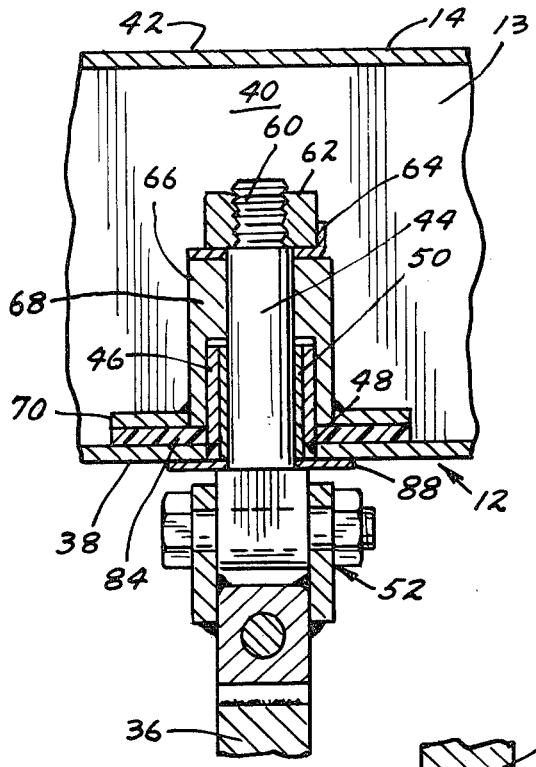
FIG. 4
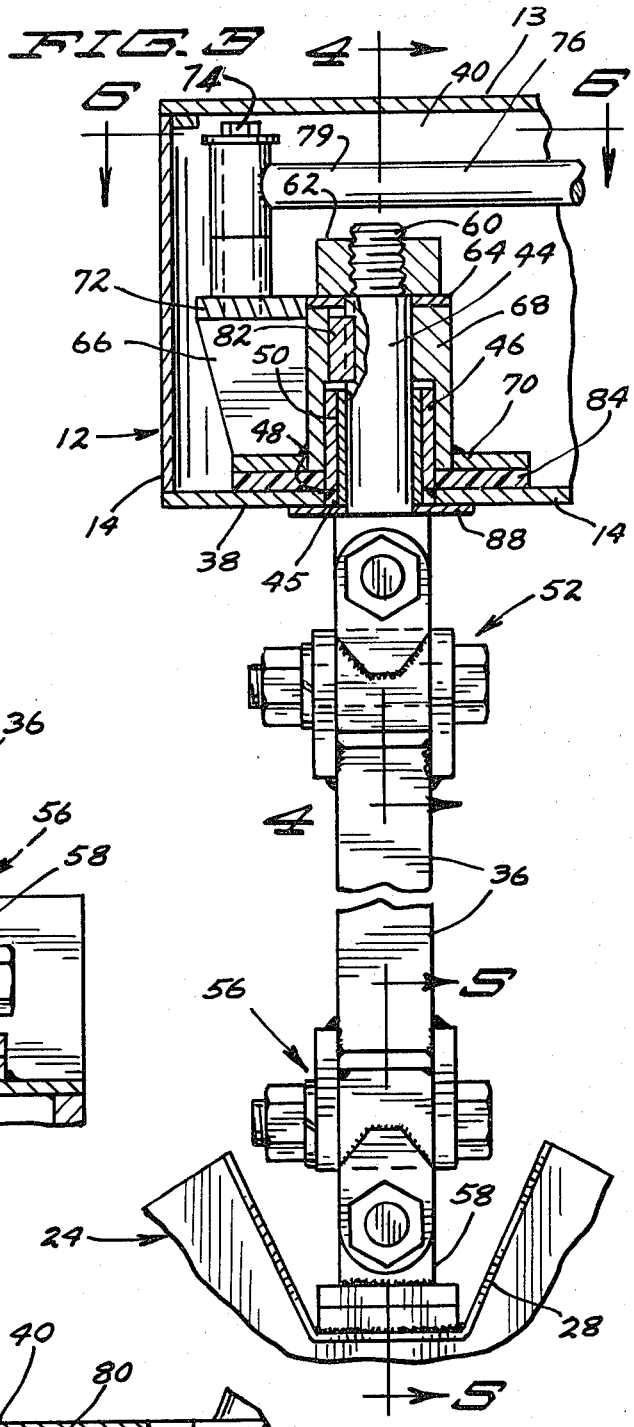
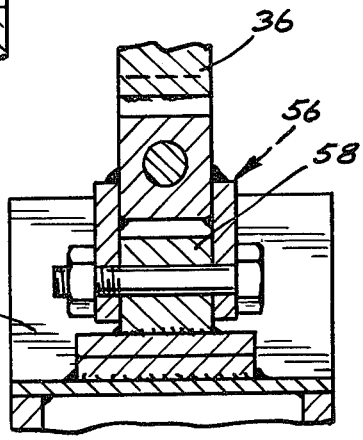
FIG. 5
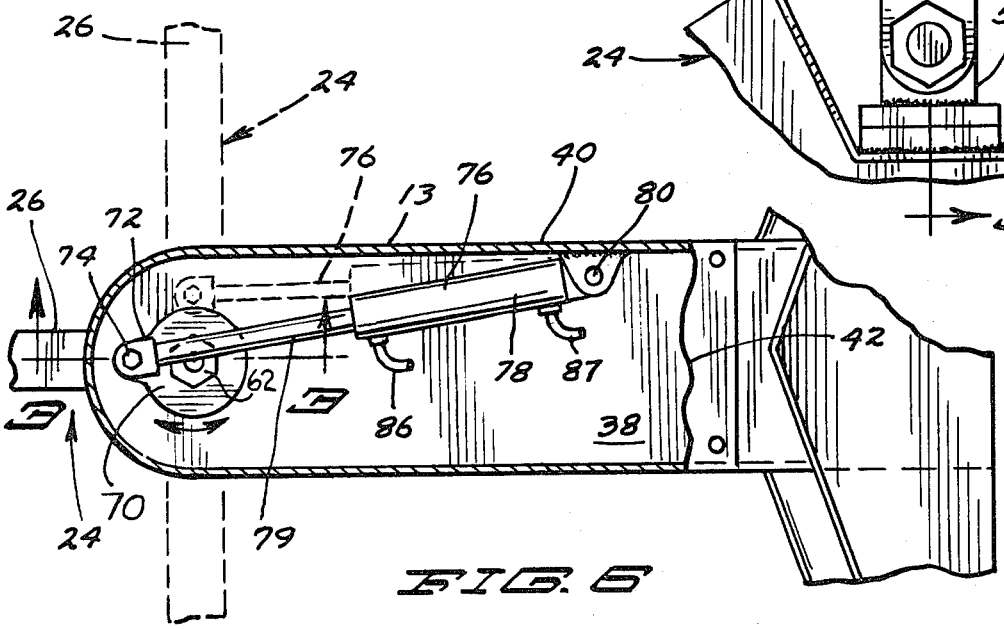
FIG. 6

ANGLE CONTROL MECHANISM FOR GRAPPLE

BACKGROUND OF THE INVENTION

This invention has relation to a pair of hydraulic grapple arms mounted to the hydraulically operated boom of a logging or skidder vehicle. The vehicle is backed up to a plurality of logs or tree stems to be skidded, the grapple arms of a grapple assembly are opened, and the boom is lowered to bring the grapple arms down around the outside of the logs, the grapple arms are closed to encompass the logs, the boom is elevated to elevate the grapple assembly and the vehicle skids the logs to a location for use.

In order that the grapple arms can encompass the logs with ease, regardless of whether or not the logs are lying in longitudinal alignment with the skidder vehicle, it is advantageous to have control over the angular position of the plane of the grapple arms so that they can be positioned substantially perpendicular to the longitudinal alignment of the majority of the logs to be encompassed.

In one instance, as disclosed in the patent to Barwise, U.S. Pat. No. 3,841,507, granted in October of 1974, before the present invention, a flexible connector was utilized between the point of the boom and a grapple block from which the grapple arms are pivotally mounted. In order for these grapple arms to be placed to encompass the end portions of logs or tree stems, the grapple arms had to be opened and then cast in an outward direction much the same as a bucket on a dragline has to be cast only on a smaller scale. In some instances, unless the operator exercised a substantial degree of skill, the grapple assembly would turn off or twist about a vertical axis, thereby often necessitating two or three different casts before placing the grapple arms on either side of the load. Also, such grapple arms are easily deflected by limbs, brush or the like. While many operators soon developed the skills which assured efficient use of this early form of the Barwise grapple, skidder grapple owners expressed a desire for a mechanical control over the plane of the grapple arms to reduce reliance on operator experience, training and skill.

A further difficulty with the free swinging connector between the boom point and the grapple block occurred during travel of the skidder vehicle over rough terrain on the "empty" half of the log skidding cycle, from the point where the grapple unloaded the logs to the point where the next load of logs was to be picked up. During this half of the cycle, rough terrain causes excessive movement and banging of the empty grapple assembly about all axes causing undue wear, stress and shock loading on the grapple assembly, on the connector between that assembly and the mast, and on the mast itself.

Also, a simple positive rotating mechanism to control the plane of the grapple arms is needed on certain skidders, due to their particular design. Such a control mechanism is needed on all skidders on particularly rough or steep terrain, in order to maximize the efficiency of the grapple skidder combination.

Others have attempted to develop structures to positively change and control the plane of grapple arms depending from boom points on skidder vehicles. These attempts included the use of a hydraulic linear motor driving a rack to rotate a pinion. Also proposed has been the use of two linear motors, three sprockets and a sprocket chain to swing the grapple assembly. Both such types of structures are much larger, more cumbersome and more complicated than the structure of the present invention.

One prior art form of rotating mechanism for a grapple assembly utilizes a high torque, low RPM rotating hydraulic motor with a sprocket and chain speed reduction arrangement to rotate a grapple connector link connected to a grapple assembly by a single universal joint, this shaft being supported in a housing at the point of a vehicle-mounted boom on a tapered thrust bearing. With such a structure, as the vehicle turns when carrying a long load, any movement of the grapple about a vertical axis is counteracted by hydraulic pressure in the system and this pressure must be exhausted over the relief valve in the system. The hydraulic pressure, due to the speed reduction through the chain-sprocket arrangement, must be relatively high in order to develop the necessary torque on the shaft to rotate the grapple. This operating at high pressure shortens the life of the hydraulic system and can cause accelerated wear on the tapered bearing.

Also, this causes excessive heating of the hydraulic fluid which represents wasted energy.

In order to provide a simplified, long-lasting, energy efficient, inexpensive structure for rotating grapple arms with respect to the point of the boom from which they are suspended, the structure of the present invention was developed.

Applicant and those in privity with him know of no closer prior art than that discussed above; and they know of no prior art which anticipates the claims made in this application. No formal search of the prior art has been made on behalf of the applicant.

BRIEF SUMMARY OF THE INVENTION

In a load handling device having a longitudinally extending boom, a load engaging grapple assembly designed to lie in a substantially vertical single plane is pivotally and rotatably supported with respect to a boom point portion of the boom.

The boom point portion is provided with a base plate which, in turn, is provided with an opening therethrough. Bushing means extends integrally upwardly from that opening to receive a rotator shaft. A rotator shaft operator arm extends integrally outwardly from an upper portion of the rotator shaft and lies in encompassing relationship with respect to the bushing. This rotator shaft operator arm is provided with an outwardly extending bottom disc-shape base portion. A disc-shape wear plate of low friction material lies in encircling relationship to the bushing, in contact with an upper surface of the base plate, and in weight receiving relationship to said operator arm base portion. This greatly lowers the coefficient of friction with respect to the base portion of the operator arm and with respect to the upper surface of the base plate over the coefficient of friction between those two parts rubbing together.

In the form of the invention as shown, a grapple assembly load bearing nut is fastened on an upper threaded shoulder bolt portion of the rotator shaft to bear against an upper portion of the rotator shaft operator arm in such a manner that the weight of the grapple assembly depending from the rotator shaft is supported on the wear plate through the rotator shaft operator arm and its outwardly extending disc-shape base portion.

In the form of the invention as shown, an upper portion of the grapple assembly is supported from a lower universal joint which is supported from a lower portion of a grapple assembly connector shank; and an upper portion of this connector shank is supported from an upper universal joint which is, in turn, connected to a lower end portion of the rotator shaft.

Without losing all of the advantages of the invention, other means, such as horizontal pivotal connections on axes lying at right angles with respect to each other, could be used to connect a grapple assembly connector shank or its equivalent between the rotator shaft in the boom point and an upper portion of the grapple assembly.

The plane of the grapple assembly is rotated with respect to a vertical plane passing through the longitudinal axis of the boom through the instrumentality of a double acting linear motor connected between the boom and an outer end portion of the rotator shaft operator arm. In the form of the invention shown, this linear motor is disclosed as a double acting, hydraulic, piston-cylinder motor. The hydraulic controls for the motor are such that when the skidder vehicle and grapple assembly are loaded and hauling logs, hydraulic fluid can pass substantially freely between the ends of this double acting motor.

At all times except when the grapple is actually being rotated by the linear motor, the hydraulic system is operating under no load conditions with the hydraulic fluid from its pressure source passing freely back to its reservoir or tank and there is no force on to restrain it from rotating to accommodate the angle of the load with respect to the load handling device.

IN THE DRAWINGS

FIG. 1 is a side elevational view of a grapple assembly supported by a connector shank to the point of a boom assembly of a partially shown logging or skidder vehicle with the grapple arms of the grapple assembly encompassing a load of logs or tree stems to be skidded;

FIG. 2 is a top plan view of the structures of FIG. 1;

FIG. 3 is an enlarged sectional view taken on the line 3—3 in FIG. 2 and FIG. 6 but with the arms of the grapple assembly rotated through 90° from the position as seen in FIG. 2;

FIG. 4 is a vertical sectional view taken on the line 4—4 in FIG. 3;

FIG. 5 is a vertical sectional view taken on line 5—5 in FIG. 3;

FIG. 6 is a reduced horizontal sectional view taken on line 6—6 in FIG. 3;

DESCRIPTION OF PREFERRED EMBODIMENT

Figure 7:
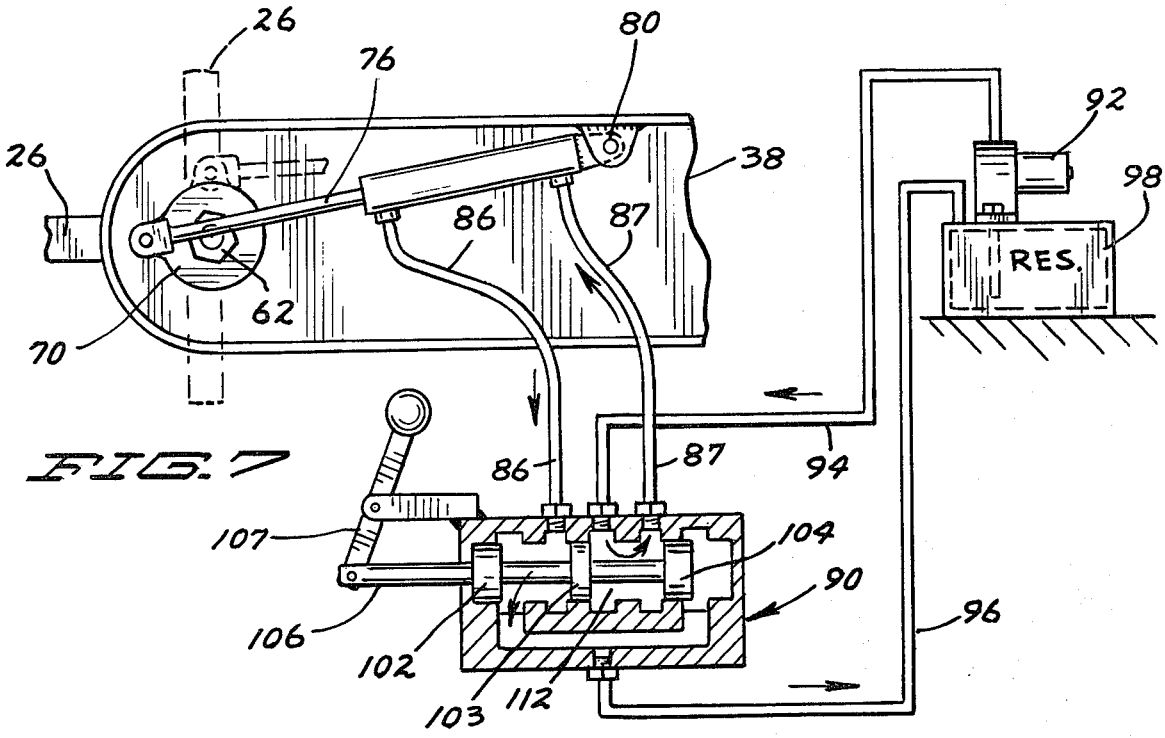
FIG. 7 is a reduced fragmentary top plan view of the structure seen in FIG. 6 combined with a schematic view of a hydraulic control valve and hydraulic system forming part of the angle control mechanism of the invention, and showing the control valve in a position to position the grapple as seen in full lines in FIGS. 6 and 7.

A logging or skidder vehicle 10 has a boom assembly 12 mounted thereon. This boom assembly includes a boom or base member 14 made up of upwardly extending struts 15,15 connected by a boom point housing 13, and linear, hydraulic, boom position motors 16 operating between the struts and the frame of the vehicle 10.

In the form of the invention shown, a winch 17 is mounted to the frame of the vehicle and a main line 19 extends from that winch over a suitable fair lead block 18 to a choker loop 20 to encompass logs 22 to be skidded.

A grapple assembly 24 includes a pair of grapple arms 26,26 pivotally mounted to a grapple block 28, and a pair of linear, hydraulic, grapple arm control motors 30,30 connected between the grapple block and the grapple arms. Appropriate hydraulic lines 32 extend from these linear motors 30,30 to suitable controls and a source of hydraulic fluid under pressure (not shown) to render the motors double acting in any usual or preferred manner not shown and not forming any part of the present invention.

In accordance with the present invention, the grapple block 28 is connected to the boom point housing 13 through the instrumentality of a grapple assembly connector shank 36 in a manner now to be described.

The boom point housing 13 includes a base plate 38, upstanding side walls 40, and a removable cover plate 42. A rotator shaft 44 is rotatably mounted in a provided opening 45 in the base plate 38. To mount and support this rotator shaft 44, a steel bushing 46 is welded to base plate 38 around the opening 45 as at 48. A bronze sleeve bushing 50 is press fit inside of the steel bushing 46, and the rotator shaft 44 rotates on the interior surface of this bronze bushing.

The rotator shaft 44 is connected by a first or upper universal joint 52 to the grapple assembly connector shank 36. This connector shank is in turn connected through a second or lower universal joint 56 to an upstanding grapple assembly support lug 58 extending integrally upwardly from the grapple block 28.

The upper end portion of the rotator shaft 44 is constituted as a threaded shoulder bolt 60, and a grapple assembly load bearing nut 62 is fixedly positioned on this shoulder bolt by a lock washer 64.

A rotator shaft operator arm 66 includes a cylindrical portion 68 and an integral outwardly extending disc shape base portion 70 both in surrounding relation to rotator shaft 44 and steel bushing 46. Rotator shaft operator arm 66 also includes a radially outwardly extending lever portion 72 to which is mounted an operator arm pivot pin 74.

A linear, hydraulic, grapple assembly angle control motor 76 includes a cylinder 78 pivotally mounted as at 80 to an interior surface of the side wall 40 of the boom point housing 13, and a piston rod 79 operably mounted with respect to the lever portion 72 of the rotator shaft operator arm 66 through the instrumentality of the operator arm pivot pin 74.

Rotator shaft operator arm 66 is locked to the rotator shaft 44 through the instrumentality of a key 82 operating in appropriate key slots in the rotator shaft and in the cylindrical portion 68 of the operator arm 66. A wear plate or disc 84 of polyethylene or other suitable material is situated between the under surface of the disc-shape base portion 70 of the rotator operator arm 66 and the upper surface of the base plate 38 of the boom point housing 13. A dust plate 88 around rotator shaft 44 and under base plate 38 completes the bearing assembly.

Hydraulic line 86 extends from the rod end of linear angle control motor 76 and hydraulic line 87 extends from the base end of that motor to a three position hydraulic control spool valve 90. A source of hydraulic fluid under pressure shown as hydraulic pump 92 is connected by a relatively high pressure hydraulic line 94 to a central portion of the hydraulic control spool valve 90. Opposite end portions of the spool valve 90 are connected through a hydraulic exhaust line 96 to a hydraulic reservoir or tank 98 which supplies the hydraulic fluid to the low pressure side of the pump 92.

Spool valve 90 consists of a cylindrical body 100 in which is mounted the first valve piston 102, a second valve piston 103, and a third valve piston 104. These pistons are connected together by a stem 106 which is in turn controlled by the valve handle 107. The valve pistons separate the valve body 100 into a left valve chamber 108 and a right valve chamber 112. Movement of the handle 107 changes the positioning of these chambers relative to the hydraulic lines 86 and 87 of the angle control motor 76 and relative to the pressure line 94 and the exhaust line 96.

When it is desired to have the grapple assembly 24 and grapple arms 26 positioned as seen in full lines in FIG. 7, the valve handle 107 will be positioned as seen in that figure so that the right valve chamber 112 is open to hydraulic line 87 and high pressure hydraulic line 94 from the pump 92.

Figure 9:
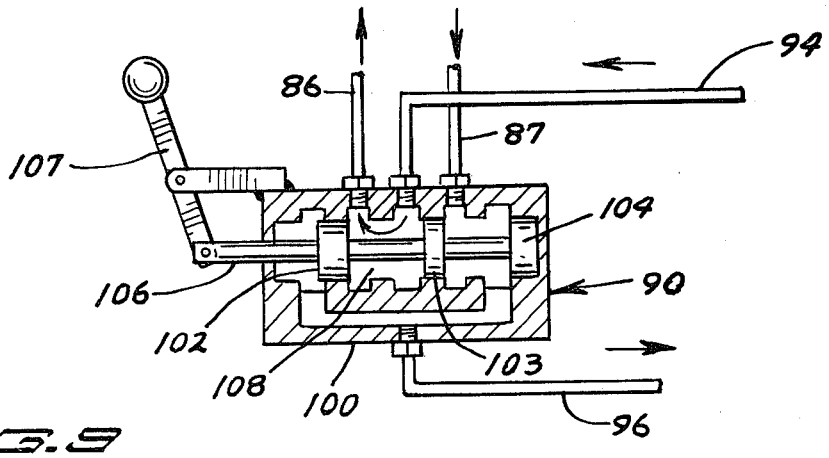
FIG. 9 is also a fragmentary schematic view of the hydraulic system of FIG. 7 but with the control valve shown in position to cause the grapple arms to be positioned as seen in dotted lines in FIGS. 6 and 7.

When it is desired that the grapple arms 26 be positioned as seen in dotted lines in FIG. 7, the valve handle 106 will be positioned as seen in FIG. 9 so that the line 86 will be open through the left valve chamber 108 to the high pressure line 94 from the pump 92. In each of these cases, the other hydraulic line from the linear grapple assembly angle control motor 76 will be open through the opposite chamber to hydraulic exhaust line 96 and the tank or reservoir 98.

Figure 8:
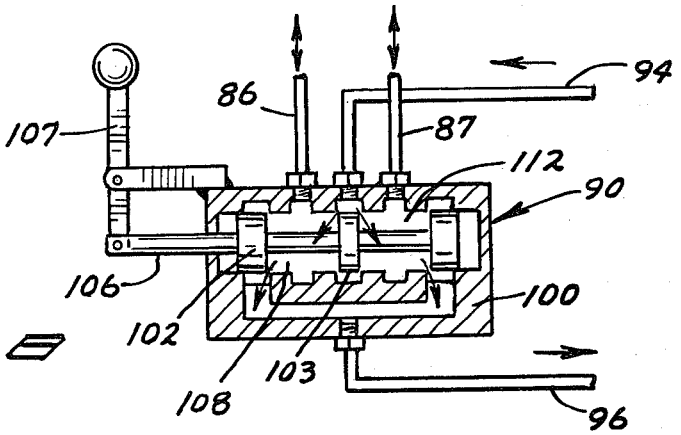
FIG. 8 is a fragmentary schematic view of the hydraulic system of FIG. 7 showing the control valve in position to allow the grapple arms to be turned freely.

With the grapple arms in either of these positions or in any intermediate position, the valve handle 107 can be moved to the position as seen in FIG. 8 where the high pressure hydraulic line 94 will be open to both the left and right chambers 108 and 112, respectively, and through those chambers to line 96 and the tank 98. In this configuration, the hydraulic pressure from the pump 92 is unloaded to tank 98 and the grapple assembly 24 including the grapple arms 26,26 are free to move about the vertical axis of rotator shaft 44 without resistance within linear motor 76 as the skidder vehicle 10 turns with relationship to the load of logs being encircled by the grapple arm. In this configuration, when the grapple is unloaded, the grapple assembly 24 can be manually rotated to any desired position without any hydraulic pressures within the motor 76 to overcome, and without any load on the hydraulic system. This results in less heating of hydraulic fluid within the system.

In the form of the invention shown, choker loop 20 is positioned around the logs 22 in the manner described in the patent to Barwise, U.S. Pat. No. 3,841,507. However, the angle control mechanism of the invention will be equally effective for the purpose of aligning the plane of a grapple assembly in perpendicular relationship with respect to the logs to be skidded whether or not there is a main line and a choker loop associated with the logs and whether or not such main line and choker loop are in any way fastened to the grapple arms.

In operation, with the grapple arms 26 positioned as seen in full lines in FIG. 6, when it is desired to position the grapple assembly 24 and the grapple arms 26 as seen in dotted lines in that figure preparatory to skidding logs 22 which are lying in alignment with the longitudinal axis of the skidder vehicle 10, control valve 90 will be activated to retract the piston rod 79 into the cylinder 78 until the motor or actuator 76 and grapple arms 26 take the position as seen in dotted lines in that figure. With the grapple assembly and grapple arms so positioned, the arms can be opened, the boom assembly 12 lowered to bring the outer ends of the arms down on either side of the logs 22 to be skidded, the arms closed, and the boom raised so that the logs can be skidded in the manner set out in the aforementioned Barwise patent or in any other usual or preferred manner.

Should the logs to be skidded not be aligned exactly with the skidder vehicle, the grapple assembly and grapple arms can be rotated in a counterclockwise direction from the position as seen in dotted lines in FIG. 6 by extending the linear motor 76, or can be moved in a clockwise direction by contracting that motor. Thus logs lying at any angle whatever at the rear of the skidder can be accommodated. In the configuration shown, the grapple assembly can be rotated through more than 360° by utilizing manual operation or momentum of the rotating grapple assembly to pass by the two "dead center" positions when the piston rod axis passes over the center of rotator shaft 44.

When the grapple assembly 24 rotates, it is due to the rotation of the universal joint 56, the grapple assembly connector shank 36 and the universal joint 52 connecting with the rotator shaft 44. This rotator shaft and the rotator shaft operator arm 66 rotate with respect to the bronze sleeve bushing 50, the steel bushing 46, and the polyethylene wear plate or disc 84 resting on the upper surface of the base plate 38 of the boom point housing 13. Thus the wear plate 84 takes all of the wear due to vertical load of the grapple assembly, and very greatly reduces the friction between the base plate 38 and the base portion 70 of the operator arm 66 over what it would be if these parts were in contact with each other. After two months of use of a prototype of the invention in the woods, such a plate showed only 0.0015 inches (0.0381 mm) wear. If and when wear on plate 84 becomes excessive, it is a simple matter to remove the cover plate 42 of the boom point housing 13, remove the load bearing nut 62 and the rotator operator arm 66 to replace this wear plate.

The construction of the grapple assembly connector shank 36 and the universal joints 52 and 56 connecting the grapple block 28 to the rotator shaft 44 to make it possible for the operator of a skidder vehicle 10 to carry a load of logs over soft or slippery ground while still maintaining that load in the grip of the grapple arms. Should the skidder vehicle 10 become stuck, the main line 19 can be released by releasing the brake (not shown) on the winch 17, and the grapple assembly and log load can be lowered to the ground by extending the boom position motors 16 to lower the boom assembly 12. The skidder 10 can then be driven forward without the load of the logs on it for a distance of between eight to ten feet (2.4 to 3.3 meters) with the grapple arms 26,26 still maintaining a hold on the load of logs. The brakes on the vehicle 10 are then set, and/or the vehicle is otherwise anchored against rearward movement, and the winch 17 is activated to cause the main line 19 to draw the logs 22 up to the rear end of the vehicle. Without taking any of the load off of the main line, the boom 14 can be raised through the instrumentality of the boom position motors 16. When the load is in touch with the back end of the skidder vehicle 10, it can again be set down on the ground by releasing the main line and lowering the boom. The skidder vehicle can again be driven forward to the limit of the extension permitted by the boom and the grapple assembly connector shank 36, the vehicle fixed against rearward movement, and the main line again drawn in. This can be repeated until such time as the vehicle is once again on solid ground and can carry the logs 22 in the more usual manner to the point where they are to be finally discharged.

This extended connection between the rotator shaft 44 and the grapple assembly 24 consisting of the two universal joints 52 and 56 and the grapple assembly connector shank 36 permit control over the vertical plane of the grapple arms 26, 26 while allowing unrestrained movement, within limits, of the upper portion of the grapple, including the grapple block 28 during the loaded cycle of operation. This permits the load to be supported over the fair lead block 18. This keeps the center of gravity of the skidder vehicle/pay load combination much lower than if the load was supported at the boom point.

The embodiments of the invention in which an exclusive property or privilege is claimed are defined as follows:

1. In a load handling device having a longitudinally extending boom and a grapple assembly lying substantially in a single vertical plane and depending from a boom point portion of said boom, a grapple assembly angle control and support mechanism to support the grapple assembly from the boom point portion and to control the angular relationship of the plane of the grapple assembly with respect to a vertical plane including the longitudinal axis of said boom, said angle control and support mechanism including:

A. a generally horizontal base plate constituted as an integral part of the boom point portion of said boom, said base plate being provided with an opening therethrough;

B. bushing means integral with said base plate and extending upwardly therefrom in encircling relationship to said base plate opening;

C. a flat wear plate encircling said bushing means and supported on an upper surface of said base plate;

D. a grapple assembly rotator shaft rotatably mounted in said bushing means and extending above said bushing means and below said base plate;

E. a rotator shaft operator arm extending radially outwardly from said rotator shaft and having an upper portion integrally attached to said rotator shaft above said bushing means, an intermediate portion encompassing said bushing means, and a lower base portion positioned to be in bearing relationship to said wear plate;

F. a double acting linear actuator operably connected between said boom and an outer end portion of said rotator shaft operator arm;

G. means to selectively lengthen and shorten said actuator;

H. connector means connecting a lower end portion of said rotator shaft to an upper portion of said grapple assembly; said connector means being operative to cause said grapple assembly to rotate on a vertical axis responsive to rotation of said rotator shaft;

I. wherein said linear actuator is constituted as a hydraulic motor having a cylinder, a piston rod, and a piston dividing said cylinder into first and second motor chambers; and J. wherein said means to selectively lengthen and shorten said actuator includes:

(1) a hydraulic pump having inlet and outlet ports, (2) a hydraulic valve having a body and movable valve means within said body, (3) conduits open from each of said first and second motor chambers and from said pump inlet and outlet ports into said valve body, (4) said valve means being movable between a first position wherein said first motor chamber is open to said pump outlet port and said second motor chamber is open to said pump inlet port, a second position wherein said first motor chamber is open to said pump inlet port and said second motor chamber is open to said pump outlet port, and a third position wherein said pump outlet port is open to said pump inlet port and said first and second motor chambers are open to each other and to said pump inlet and outlet ports, and (5) valve control means to move said valve between said first, second and third positions.

2. In a load handling device having a longitudinally extending boom and a grapple assembly lying substantially in a single vertical plane and depending from a boom point portion of said boom, a grapple assembly angle control and support mechanism to rotatably support the grapple assembly from the boom point portion and to control the angular relationship of the plane of the grapple assembly with respect to a vertical plane including the longitudinal axis of said boom, said angle control and support mechanism including:

A. a grapple assembly rotator shaft;

B. means to rotatably support said rotator shaft with respect to said boom point portion of said boom to maintain the axis of said rotator shaft generally upright and in a vertical plane including the longitudinal axis of the boom;

C. a rotator shaft operator arm extending radially outwardly from said rotator shaft in adjacent relation to said boom point portion of said boom, said rotator shaft operator arm being mounted to rotate with the rotator shaft;

D. a double acting linear actuator operably connected between said boom and an outer end portion of said rotator shaft operator arm;

E. means to selectively lengthen and shorten said actuator;

F. a first upper universal joint connected to said rotator shaft below said boom point portion;

G. a second lower universal joint connected to an upper portion of said grapple assembly;

H. a grapple assembly connector shank connected between said upper and lower universal joints;

I. wherein said linear actuator is constituted as a hydraulic motor having a cylinder, a piston rod, and a piston dividing said cylinder into first and second motor chambers; and J. wherein said means to selectively lengthen and shorten said actuator includes:

(1) a hydraulic pump having inlet and outlet ports, (2) a hydraulic valve having a body and movable valve means within said body, (3) conduits open from each of said first and second motor chambers and from said pump inlet and outlet ports into said valve body, (4) said valve means being movable between a first position wherein said first motor chamber is open to said pump outlet port and said second motor chamber is open to said pump inlet port, a second position wherein said first motor chamber is open to said pump inlet port and said second motor chamber is open to said pump outlet port, and a third position wherein said pump outlet port is open to said pump inlet port and said first and second motor chambers are open to each other, and (5) valve control means to move said valve between said first, second and third positions.

3. In a load handling device having a longitudinally extending base member and a material handling assembly depending from said base member, a material handling assembly angle control and support mechanism to rotatably support the assembly from the base member and to control the angular relationship of the assembly with respect to a vertical plane including the longitudinal axis of said base member, said angle control and support mechanism including:

A. a material handling assembly rotator shaft;

B. means to rotatably support said rotator shaft with respect to said base member to maintain the axis of said rotator shaft generally upright and in a vertical plane including or parallel to the longitudinal axis of the base member;

C. a rotator shaft operator extending radially outwardly from said rotator shaft in adjacent relation to said base member, said rotator shaft operator being mounted to rotate with the rotator shaft;

D. a double acting linear hydraulic motor operably connected between said base member and an outer portion of said rotator shaft operator; and said motor including a cylinder, a piston rod, and a piston dividing said cylinder into first and second motor chambers;

E. hydraulic motor drive means to selectively lengthen and shorten said motor, said motor drive means including:

(1) a hydraulic pump having inlet and outlet ports, (2) a hydraulic valve including:

(a) a valve body having spaced intermediate portions each open to one of said first and second motor chambers, a central portion between the intermediate portions open to said pump outlet port and oppositely spaced outer end portions both open to said pump inlet port, (b) spaced apart valve pistons in said valve body movable between a first position wherein said first motor chamber is open through said valve body to said pump outlet port and said second motor chamber is open through said valve body to said pump inlet port, a second position wherein said first motor chamber is open through said valve body to said pump inlet port and said second motor chamber is open through said valve body to said pump outlet port, and a third position wherein said first and second motor chambers are open to each other, and said pump inlet and outlet ports are open to each other, (3) valve control means to move said valve between said first, second and third positions; and F. connector means connecting a lower end portion of said rotator shaft to an upper portion of said material handling assembly, said connector means being operative to cause said assembly to rotate on a vertical axis responsive to rotation of said rotator shaft.

4. In a load handling device having a base member and a material handling assembly depending from said base member, a material handling assembly angle control and support mechanism to rotatably support the assembly from the base member portion and to control the angular relationship of the assembly with respect to a vertical plane which includes at least two predetermined points within said base member, said angle control and support mechanism including:

A. a material handling assembly rotator shaft;

B. means to rotatably support said rotator shaft with respect to said base member to maintain the axis of said rotator shaft generally upright and in a vertical plane coextensive with or parallel to a vertical plane which includes at least two predetermined points within said base member;

C. a rotator shaft operator extending radially outwardly from said rotator shaft in adjacent relation to said base member, said rotator shaft operator being mounted to rotate with the rotator shaft;

D. a double acting linear hydraulic motor operably connected between said base member and an outer portion of said rotator shaft operator; said motor including a cylinder, a piston rod, and a piston dividing said cylinder into first and second motor chambers;

E. hydraulic motor drive means to selectively lengthen and shorten said motor, said motor drive means including:

(1) a hydraulic pump having inlet and outlet ports, (2) a hydraulic valve having a body and movable valve means with said body, (3) conduits open from each of said first and second motor chambers and from said pump inlet and outlet ports into said valve body, (4) said valve means being movable between a first position wherein said first motor chamber is open to said pump outlet port and said second motor chamber is open to said pump inlet port, a second position wherein said first motor chamber is open to said pump inlet port and said second motor chamber is open to said pump outlet port, and a third position wherein said first and second motor chambers are open to each other, and (5) valve control means to move said valve between said first, second and third positions; and F. connector means connecting a lower end portion of said rotator shaft to an upper portion of said material handling assembly, said connector means being operative to cause said assembly to rotate on a vertical axis responsive to rotation of said rotator shaft.

* * * * *